US005980303A

United States Patent [19]

Lee et al.

[11] Patent Number: 5,980,303

[45] Date of Patent: Nov. 9, 1999

[54] INSULATION DISPLACEMENT CONNECTOR

[75] Inventors: George Lee, Taipei; Jerry Wu, Chang-Hua Hsien, both of Taiwan

[73] Assignee: Hon Hai Precision Ind. Co., Ltd., Taipei Hsien, Taiwan

[21] Appl. No.: 08/979,635

[22] Filed: Nov. 28, 1997

[30] Foreign Application Priority Data

Nov. 27, 1996 [TW] Taiwan ..... 85218413

[51] Int. Cl.[6] ..... H01R 13/38

[52] U.S. Cl. ..... 439/405

[58] Field of Search ..... 439/399, 400, 439/404, 405, 406, 499

[56] References Cited

U.S. PATENT DOCUMENTS 4,410,222 10/1983 Enomoto et al. ..... 439/399
4,410,229 10/1983 Stephenson ..... 439/405
4,641,904 2/1987 Kosugi et al. ..... 439/404
4,668,039 5/1987 Marzili ..... 439/404
4,669,801 6/1987 Worth ..... 439/404

*Primary Examiner*—Michael L. Gellner
*Assistant Examiner*—Briggitte R. Hammond

[57] ABSTRACT

An insulation displacement connector is used to engage with a flat cable by inserting an insulative cover thereof into an insulative housing thereof to a half-insertion status thus defining a space between the insulative cover and the insulative housing for reception of a predetermined section of the flat cable, and then compressing the insulative cover to fully engage the insulative housing thus forcing contacts in the insulative housing to pierce the predetermined flat cable and electrically connect to the related conductive lines enclosed in sheaths of the flat cable.

9 Claims, 8 Drawing Sheets

INSULATION DISPLACEMENT CONNECTOR

BACKGROUND OF THE INVENTION

1. Field of the Invention

The present invention relates to an insulation displacement connector and particularly to an insulation displacement connector which includes engaging means and flat cable configuration alignment means for positioning the flat cable in a proper position during configuration.

2. The Prior Art

Insulation displacement connectors, also known as flat cable connectors or ribbon cable connectors, are widely used to configure cables in a cable assembly for transmitting signals between computers and peripheral devices. Generally, the flat cable consists of a plurality of parallel conductive lines each of which is enclosed in a sheath made of an insulative material such as plastic. An insulation displacement connector is commonly used to connect the flat cable by piercing the corresponding sheath of each line and fixing the flat cable at an engaging line which is substantially perpendicular to the elongate direction of the flat cable. Each insulation displacement connector usually comprises an insulative cover, an insulative housing, and a plurality of contacts received in the insulative housing. While configuring the connector with the flat cable, the insulative cover and the insulative housing are coupled in a first status thus defining a reception space therebetween for reception of a section of the flat cable. The insulative cover is then compressed onto the section of the flat cable (referred to as engagement section hereinafter) and the insulative housing by a jig or the like to facilitate the related contacts of the insulative housing to pierce the sheath of the flat cable and electrically engage with the conductive lines originally enclosed in the sheaths of the flat cable. Meanwhile, the engagement section of the flat cable is fixed between the insulative cover and the insulative housing. However, in a practical configuration, the engagement section of the flat cable is not always located at an optimum position for correct piercing by the related contacts of the insulative housing. Some prior art has formed the insulative cover to be clip-shaped or consisting of two pieces so as to solve the improper piercing problem. Such prior art has been disclosed in U.S. Pat. Nos. 3,820,055; 4,068,912; 4,188,083; 4,260,209; 4,359,257; 4,410,222; 4,410,229; 4,475,786; 4,668,039; 4,681,382; and 4,897,041. Although the piercing problem seems to be solved by some prior art, problems due to either an exceedingly wide or narrow flat cable with respect to the reception space defined between the insulative cover and the insulative housing usually cause an unwanted curved portion or a misalignment configuration at the engagement section of the flat cable, thus reducing the yield of the cable assembly.

SUMMARY OF THE INVENTION

The primary purpose of the present invention is to provide a new insulation displacement connector for proper connection to a flat cable while preventing misalignment or unwanted compression on the flat cable.

In accordance with one aspect of the present invention, an insulation displacement connector for engaging with a flat cable comprises: an insulative housing having a plurality of contacts projecting therefrom, two receptacles at two sides thereof, and both a first positioning means and a second positioning means vertically formed in each of the two receptacles; an insulative cover having an elongate portion on which a plurality of waved grooves are formed and two longitudinal arms respectively connected to two ends of the elongate portion; wherein the two longitudinal arms are firstly slid downward into the two receptacles until one end of each arm is located in a first position between the first positioning means and the second positioning means thus defining a space between the elongate portion of the insulative cover and the contacts for reception of a predetermined section of the flat cable, thereafter the insulative cover is compressed downward so that each end of the two arms is further slid downward through the second positioning means and retained in a second position with respect to the insulative housing, meanwhile the waved grooves of the elongate portion of the insulative cover abut the predetermined section of the flat cable to be pierced by the contacts.

DETAILED DESCRIPTION OF THE PREFERRED EMBODIMENTS

References will now be described in detail to the preferred embodiment of the invention.

Figure 1:
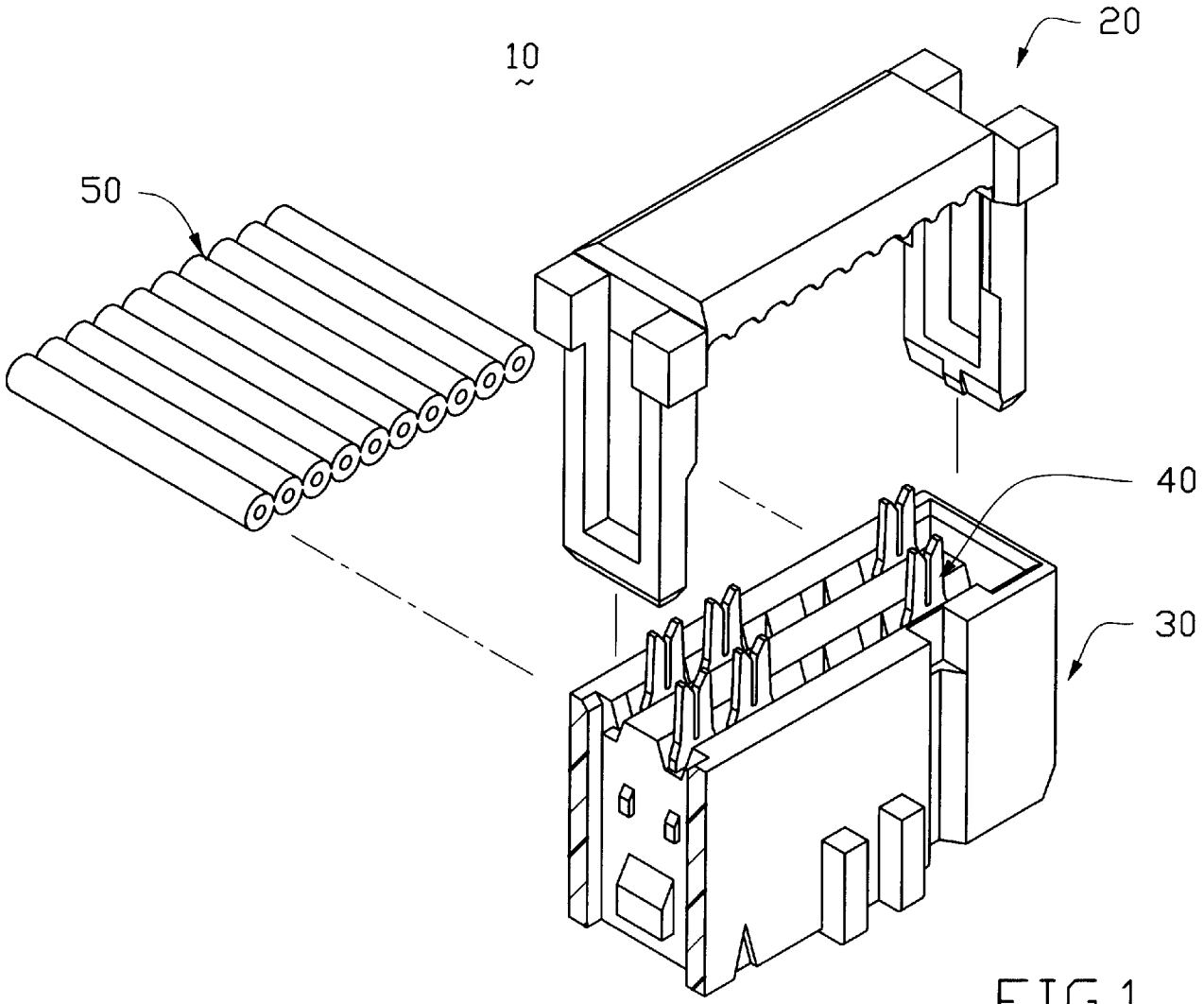
FIG. 1 is a perspective exploded view of an insulation displacement connector in accordance with the present invention having a left receptacle cut away to show an interior thereof.

Referring to the drawings and initially to FIG. 1, an insulation displacement connector 10 in accordance with the present invention comprises an insulative cover 20, an insulative housing 30, and a plurality of contacts 40 received in the insulative housing 30. A flat cable 50 is connected with the insulation displacement connector 10 from a lateral direction with respect to the orientation of this figure.

Figure 2A:
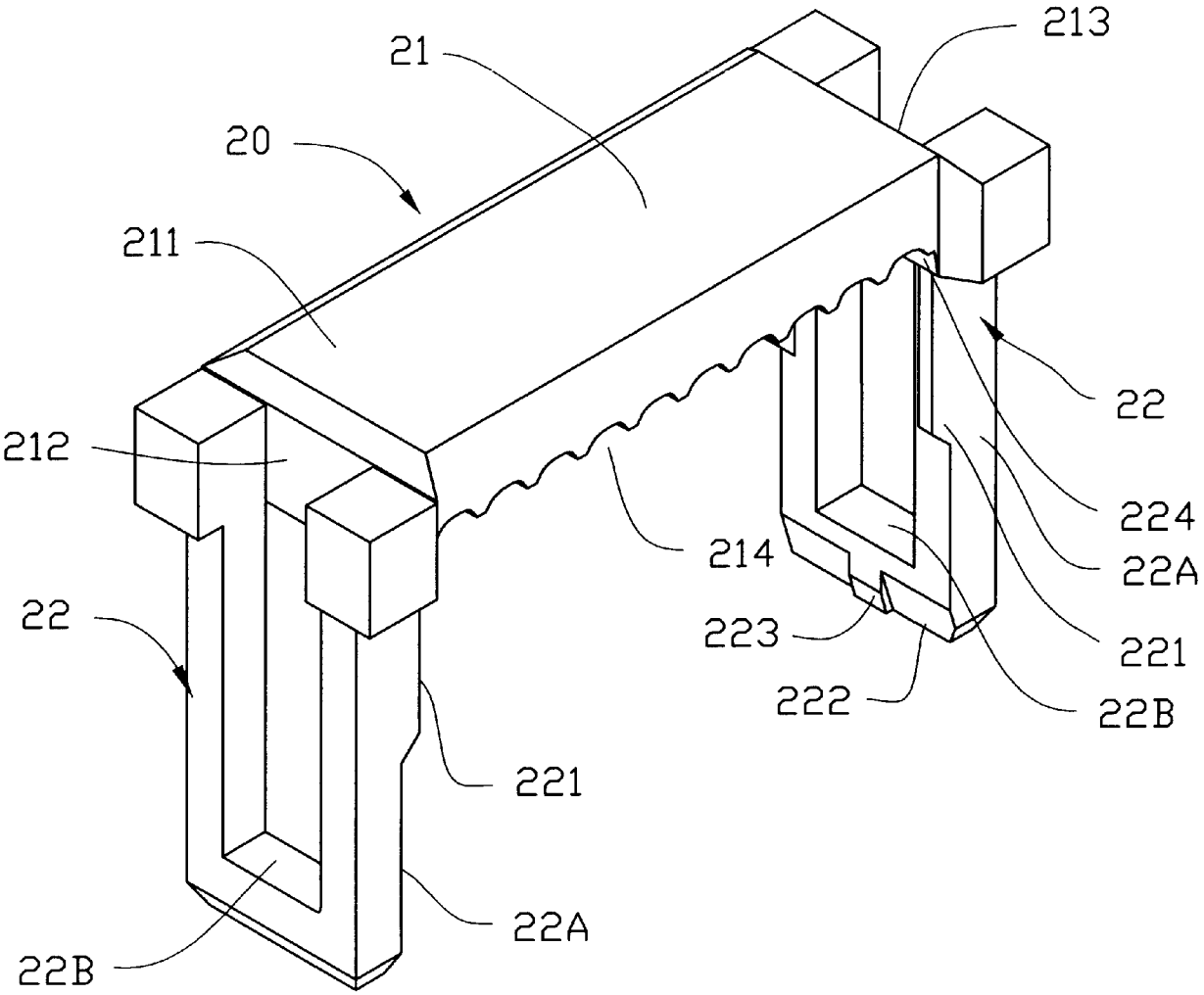
FIG. 2A is a perspective view of an insulative cover of the insulative displacement connector of FIG. 1.
Figure 2B:
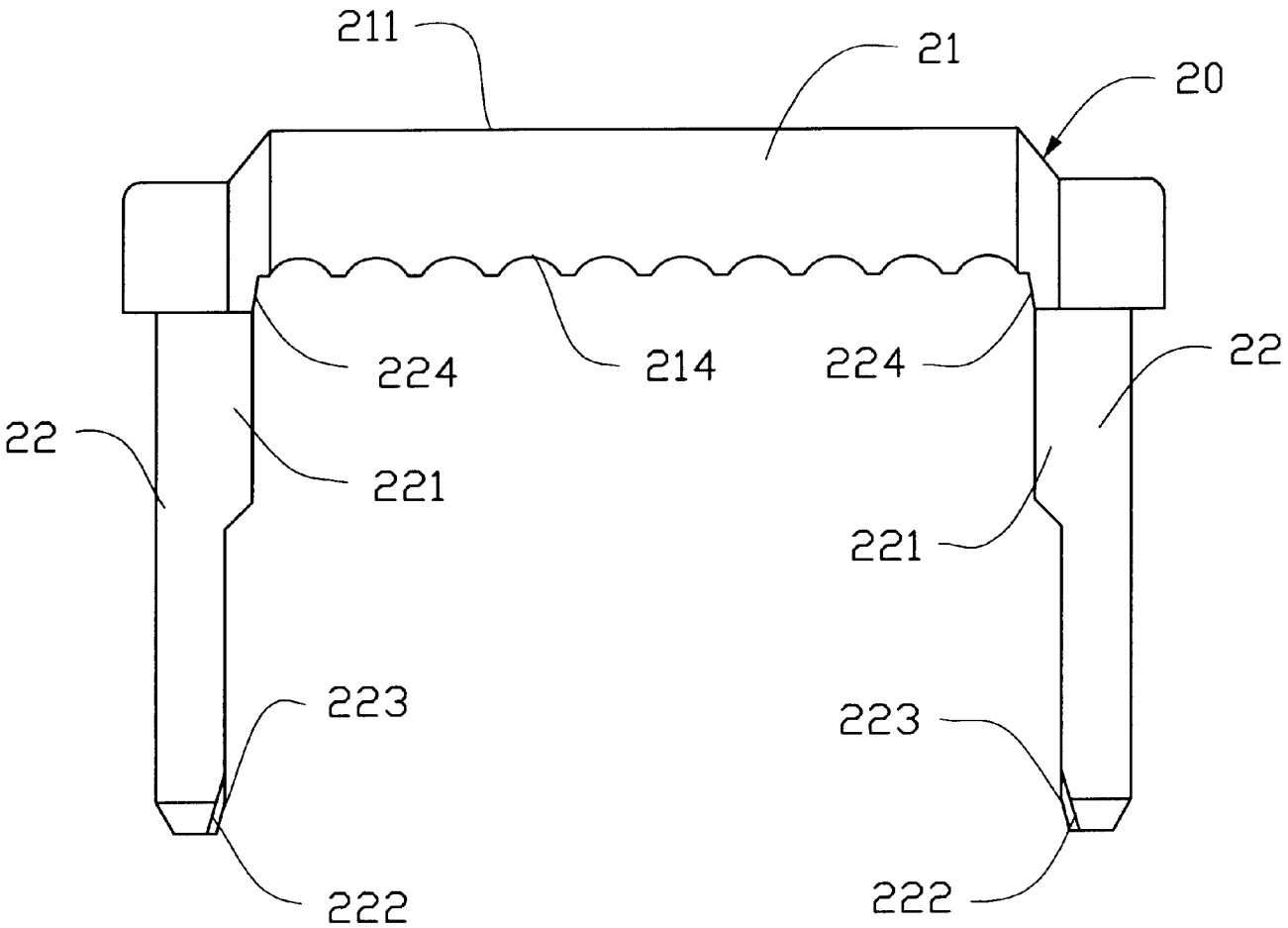
FIG. 2B is an elevational front view of the insulative cover of the insulative displacement connector of FIG. 1.

Referring to FIGS. 2A and 2B, the insulative cover 20 comprises an elongate bridging portion 21 having a first face 211 on a top thereof, a second face 212 and a third face 213 at respective ends of the elongate bridging portion 21. A fourth face 214 opposite the first face 211 defines a plurality of waved grooves 214 therein for reception and retention of a lateral section of the flat cable 50. Two downward extension engagement arms 22 are respectively connected to the second face 212 and the third face 213, thus the elongate bridging portion 21 together with the two engagement arms 22 constitute a substantially U-shaped clip to engage the insulative housing 30.

Each arm 22 is a U-shaped structure comprising two legs 22A substantially parallel to each other and a lateral portion 22B connecting the two legs 22A. Each leg 22A has a protrusion 221 projecting toward a corresponding leg 22A of the opposite arm 22. The distance between the opposite pair of protrusions 221 is predetermined to be identical to the width of the flat cable 50 so that the flat cable 50 can be fitted exactly in the space between the two pairs of opposite protrusions 221 without any compression problems occurring in the flat cable 50 when it is engaged with the insulation displacement connector 10. The two arms 22 allow the contacts 40 to align with corresponding lines (not labeled) of the flat cable 50. A tapering surface 222 is formed on the periphery of the lateral portion 22B of the arm 22. A tapering body 223 projects from an inner portion of each tapering surface 222 of the arms 22. The elongate bridging portion 21 has two tapering faces 224 adjacent to each end of the waved grooves 214. The function of the two tapering faces 224 will be described later.

Figure 3:
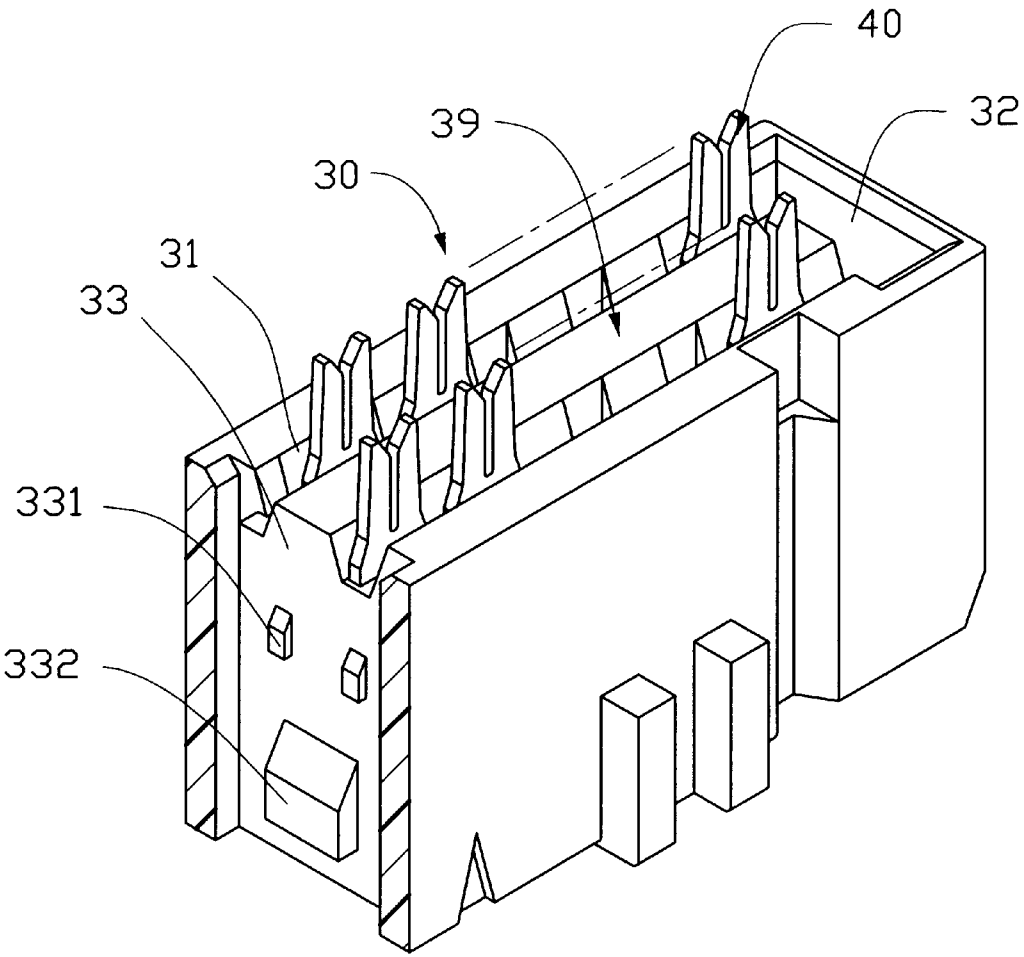
FIG. 3 is a perspective view of an insulative housing in accordance with the present invention having a left receptacle cut away to show an interior thereof.

Referring to FIG. 3, the insulative housing 30 is substantially an elongate structure which includes a body portion 39 and two receptacles 32 (only one shown) formed at two side faces 33 of the body portion 39. In this figure, the receptacle 32 at the left side is cut away to illustrate the structure of the side face 33 of the body portion 39. The body portion 39 defines two elongate grooves 31 at a top thereof each of which includes a row of the contacts 40 projecting upward. A first positioning means 331 and a second positioning means 332 are vertically formed on both the side faces 33 of the body portion 39 to have a distance therebetween substantially greater than a width of the lateral portion 22A of the arm 22. More specifically, the first positioning means 331 comprises two spaced tapering protrusions 331, each of which tapers upward near the top of the body portion 39. The second positioning means 332 comprises a tapering protrusion 332 which also tapers upward near the top of the body portion 39.

A first configuration status and a second configuration status are used to configure the flat cable 50 in the insulation displacement connector 10, which are respectively illustrated in FIGS. 4 and 5 and FIGS. 6 and 7.

Figure 4:
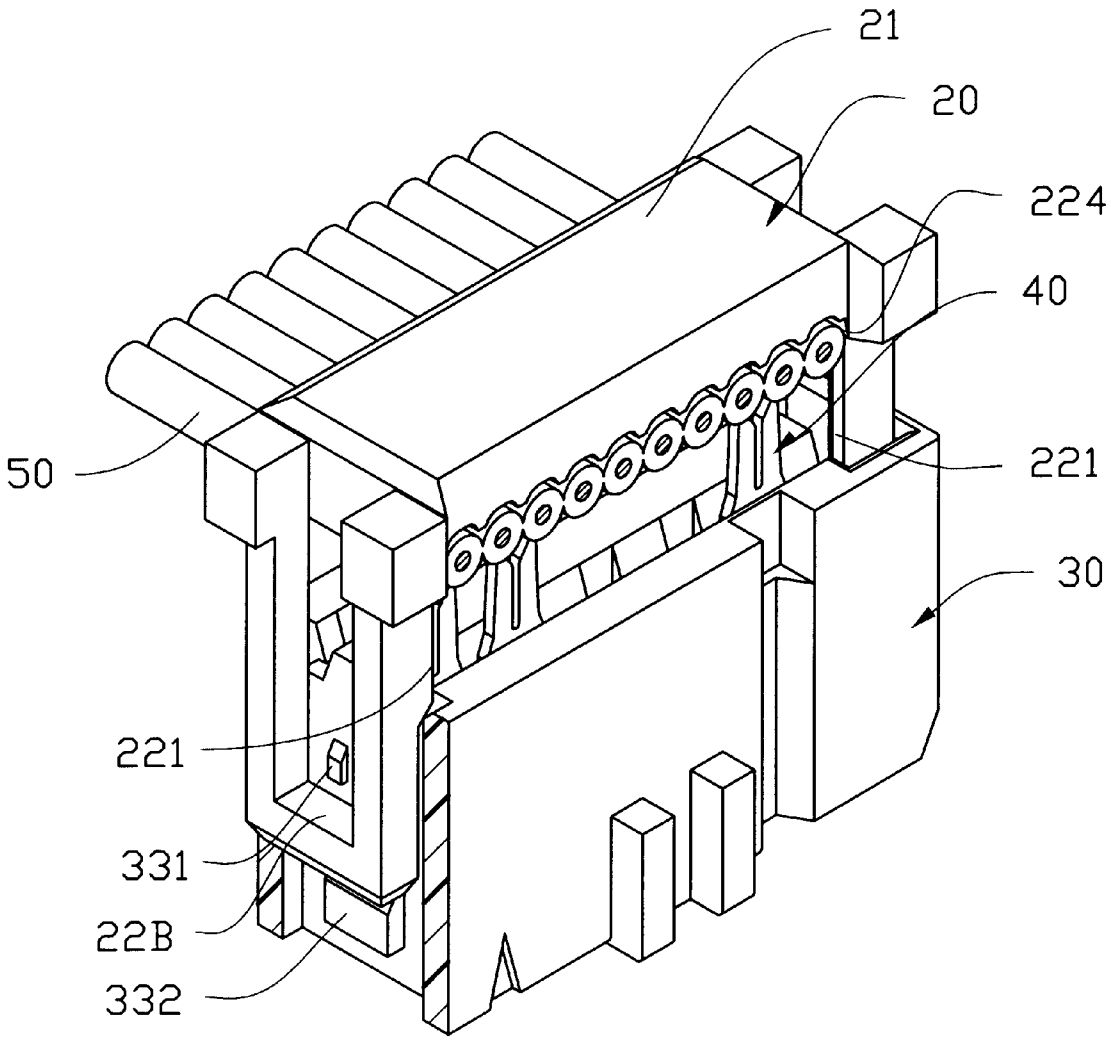
FIG. 4 is a perspective view of an assembly of the insulation displacement connector of the present invention and a flat cable, having a left receptacle cut away to show an interior thereof, where the insulative cover and the insulative housing are connected in a first status.
Figure 5:
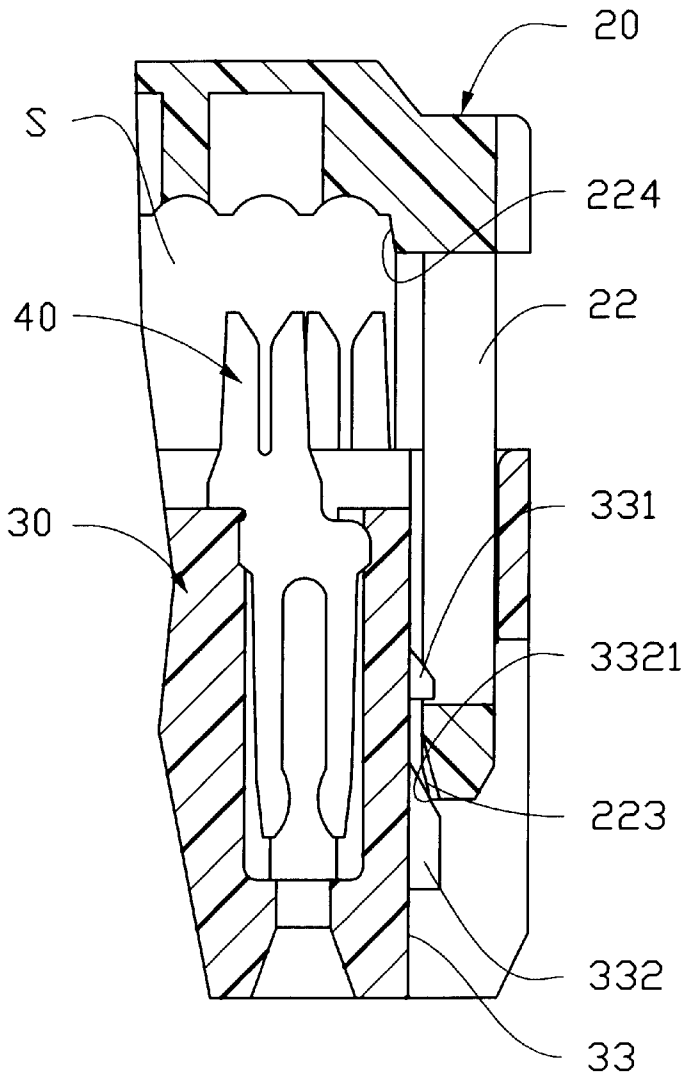
FIG. 5 is a partial, cross-sectional view taken from FIG. 4 to show the first status in more detail.

Referring to FIGS. 4 and 5, the arms 22 of the insulative cover 20 are initially inserted into the two receptacles 32, with the tapering body 223 of the lateral portion 22B of each arm 22 passing through the space defined between the two tapering protrusions 331, until the tapering body 223 abuts a tapering surface 3321 of the tapering protrusion 332, thus retaining the insulative cover 20 in a first horizontal position with respect to the insulative housing 30. Concurrently, a space S is defined between the insulative cover 20 and the tips of the contacts 40 to allow for reception of a predetermined section of the flat cable 50.

Figure 6:
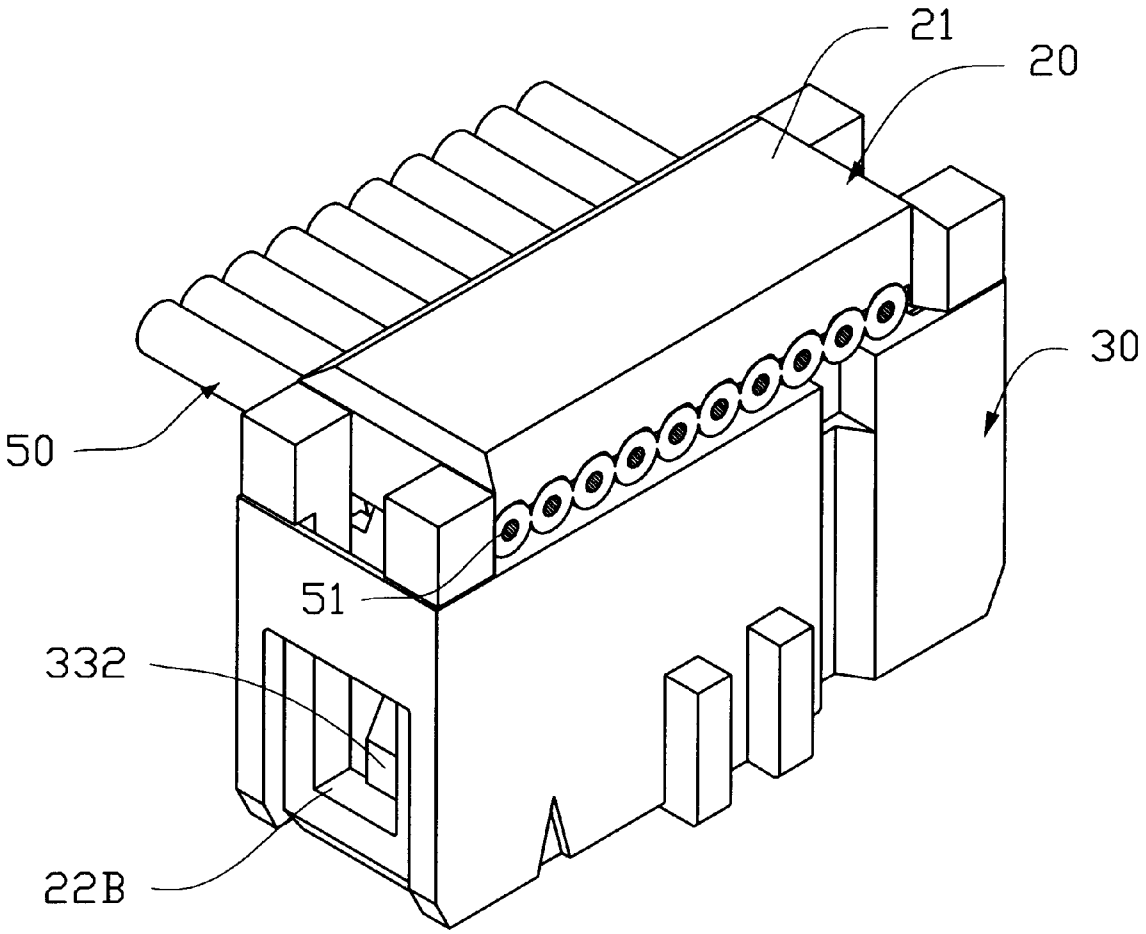
FIG. 6 is a perspective view of the insulation displacement connector showing the insulative cover fully engaged with the insulative housing.
Figure 7:
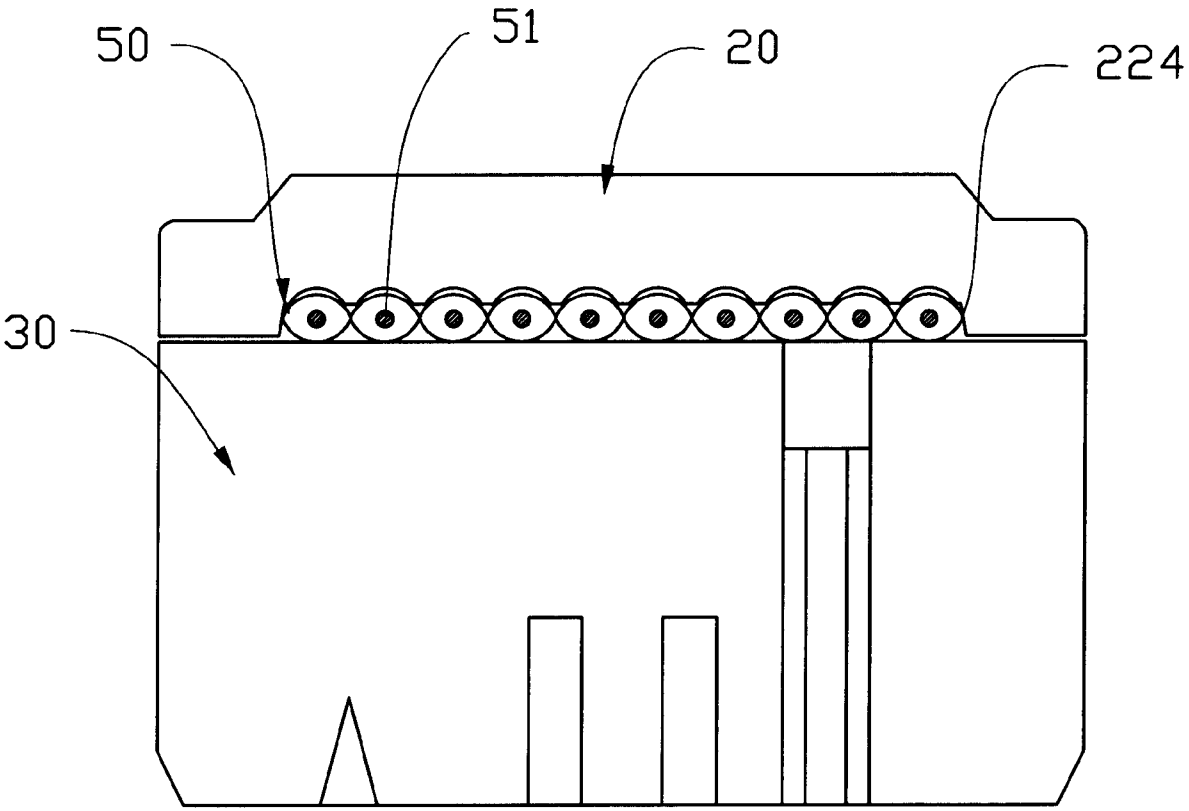
FIG. 7 is an elevational front view of the assembled connector of FIG. 6.

Referring to FIGS. 6 and 7, a jig or the like is used to further compress the insulative cover 20 so as to force the tapering body 223 of the lateral portion 22B of each arm 22 to slide through the tapering protrusion 332 of the body portion 39, thus retaining the insulative cover 20 in a second horizontal position with respect to the insulative housing 30. Meanwhile, the contacts 40 pierce the flat cable 50 and to electrically connect the related conductive lines 51. Upon depression on the insulative cover 20, the two tapering faces 224 of the elongate bridging portion 21 allow the flat cable 50 having discrepancies in the width of each line (not labeled) due to manufacturing inadequacies to be limited under the waved grooves 214 without inducing any severe deformation which results in the impossibility of assembly between the insulative cover 20, the flat cable 50, and the insulative housing 30.

With the above new insulation displacement connector 10 and the related two-status assembly method, the flat cable 50 can be properly configured with the new connector 10.

While the present invention has been described with reference to a specific embodiment, the description is illustrative of the invention and is not to be construed as limiting the invention.

Therefore, various modifications to the present invention can be made to the preferred embodiment by those skilled in the art without departing from the true spirit and scope of the invention as defined by the appended claims.

We claim:

1. An insulation displacement connector for engaging with a flat cable, comprising:

an insulative housing having a plurality of contacts projecting therefrom, two receptacles at each side thereof, and a first positioning means and a second positioning means vertically formed in each of the two receptacles;

an insulative cover comprising an elongated portion on which a plurality of waved grooves are formed and two longitudinal arms respectively connected to two ends of the elongated portion, wherein the elongated portion of the insulative cover has two tapering faces adjacent to an outermost waved grooves for preventing an predetermined section of the flat cable from being deformed when the flat cable is pierced by the contacts;

wherein the two longitudinal arms are firstly slid downward into the two receptacles until one end of each arm is located in a first position between the first positioning means and the second positioning means thus defining a space between the elongated portion of the insulative cover and the contacts for reception of a predetermined section of the flat cable, thereafter the insulative cover is compressed downward so that each end of the two arms is further slid downward through the second positioning means and retained in a second position with respect to the insulative housing, meanwhile the waved grooves of the elongated portion of the insulative cover abut the predetermined section of the flat cable to be pierced by the contacts.

2. The insulation displacement connector as claimed in claim 1, wherein the two arms are each formed with at least one inwardly projecting protrusion with a distance therebetween substantially identical to a width of the flat cable for retaining the predetermined section of the flat cable therebetween.

3. The insulation displacement connector as claimed in claim 1, wherein each end of the two arms of the insulative cover comprises a tapering surface allowing the end of each arm to slide through the first positioning means and the second positioning means, and a tapering protrusion formed on the tapering surface of the end of each arm for cooperating with the second positioning means to retain the end of the arm in the first position so as to define the space between the elongate portion of the insulative cover and the contacts before the flat cable is pierced by the contacts.

4. The insulation displacement connector as claimed in claim 1, wherein the first positioning means and the second positioning means formed in the receptacle are tapering protrusions.

5. The insulation displacement connector as claimed in claim 1, wherein the second position in which the end of each arm is retained is a final position for the end of each arm after the flat cable is fully engaged with the insulation displacement connector.

6. An insulation displacement connector for engaging with a flat cable, comprising:

an insulative housing having a plurality of contacts projecting therefrom, two receptacles at each side thereof, and a first positioning means and a second positioning means vertically formed in each of the two receptacles;

an insulative cover comprising an elongated portion on which a plurality of waved grooves are formed and two longitudinal arms respectively connected to two ends of the elongated portion;

wherein the two longitudinal arms are firstly slid downward into the two receptacles until one end of each arm is located in a first position between the first positioning means and the second positioning means thus defining a space between the elongated portion of the insulative cover and the contacts for reception of a predetermined section of the flat cable, thereafter the insulative cover is compressed downward so that each end of the two arms is further slid downward through the second positioning means and retained in a second position with respect to the insulative housing, meanwhile the waved grooves of the elongated portion of the insulative cover abut the predetermined section of the flat cable to be pierced by the contacts; and wherein each end of the two arms of the insulative cover comprises a tapering surface allowing the end of each arm to slide through the first positioning means and the second positioning means, and a tapering protrusion formed on the tapering surface of the end of each arm for cooperating with the second positioning means to retain the end of the arm in the first position so as to define the space between the elongated portion of the insulative cover and the contacts before the flat cable is pierced by the contacts.

7. The insulation displacement connector as claimed in claim 6, wherein the two arms are each formed with at least one inwardly projecting protrusion with a distance therebetween substantially identical to a width of the flat cable for retaining the predetermined section of the flat cable therebetween.

8. The insulation displacement connector as claimed in claim 6, wherein the first positioning means and the second positioning means formed in the receptacle are tapering protrusions.

9. The insulation displacement connector as claimed in claim 6, wherein the second position in which the end of each arm is retained is a final position for the end of each arm after the flat cable is fully engaged with the insulation displacement connector.

* * * * *